US006964354B2

(12) United States Patent
Arencibia Hernandez

(10) Patent No.: US 6,964,354 B2
(45) Date of Patent: Nov. 15, 2005

(54) DOUBLE METERING DISPENSER FOR HYGIENIC SUBSTANCES

(75) Inventor: Sergio Arencibia Hernandez, Las Pålmas de Gran Canaria (ES)

(73) Assignee: Docian, S.L., Las Palmas de Gran Canaria (ES)

( * ) Notice: Subject to any disclaimer, the term of this patent is extended or adjusted under 35 U.S.C. 154(b) by 180 days.

(21) Appl. No.: 10/697,047

(22) Filed: Oct. 31, 2003

(65) Prior Publication Data

US 2005/0087549 A1 Apr. 28, 2005

(30) Foreign Application Priority Data

Oct. 22, 2003 (EP) ..... 03380240

(51) Int. Cl.[7] ..... B67D 5/06
(52) U.S. Cl. ..... 222/181.3
(58) Field of Search ..... 222/181.3, 183

(56) References Cited

U.S. PATENT DOCUMENTS 4,969,580 A * 11/1990 Mikhail Ezzat A. ..... 222/181.3
5,452,825 A * 9/1995 Comstock et al. ..... 222/181.2
6,082,593 A * 7/2000 Borcherds ..... 222/181.3

* cited by examiner

*Primary Examiner*—Philippe Derakshani
(74) *Attorney, Agent, or Firm*—Dennison, Schultz, Dougherty & MacDonald

(57) ABSTRACT

A double metering dispenser for hygienic substances, consisting of a support for a pair of flexible or contractile metering receptacles in divergent projection assembled on respective arcuate support arms and housed in a lower ring provided with anchoring means which firmly fix it to the lower end of said arms, and which furthermore has a closure for the outlet opening of the receptacle and, on the upper end, is provided with an adjustment device assembled on the inside of the hood cover and inside of the upper end of the support arm with the possibility of opening vertically for releasing the receptacle retained by said hood cover.

7 Claims, 3 Drawing Sheets

DOUBLE METERING DISPENSER FOR HYGIENIC SUBSTANCES

OBJECT OF THE INVENTION

As the title indicates, the invention consists of a metering dispenser for hygienic substances, more specifically for soapy substances, gels, shampoos or the like, integrated by two metering bodies assembled in the same support or common support by independent support means which are fixed to the former by simple, removable, camouflaged attachments, and which consists of its own elements for being fixed to said common support or to any other suitable surface.

Metering dispensers which have a suitable ergonomic shape; constituted by flexible or compressible bodies which, by simple manual pressure, dispense a metered amount of hygienic substance through the outlet opening of the receptacle, located on the lower base thereof, which is fitted in a ring-shaped sector of the support element and, from above, is retained in a hood cover with means for opening and closing it and releasing the receptacle for changing it or replacing it. To do so, it is not necessary to remove the common support nor the particular support means of each dispenser receptacle.

BACKGROUND OF THE INVENTION

There are multiple substance metering dispensers of this type, which are known in their practical applications, especially in a unitary manner. They are currently of generalized use in public restrooms and tend to become established in the bathrooms of establishments intended for lodging, offices or centers in which the restrooms are of shared use. The dispensers in question have metering mechanisms of very diverse construction. There are those which are operated by means of a pulling element; a push button, a pressing means and some by the compressive effect on the receptacle itself. Each has a suitable structure or shape and very different designs.

In any case, the background of the object of the invention is in Utility Model No. 200201642/9, for a "METERING DISPENSER FOR HYGIENIC SUBSTANCES" of the same applicant, which has general basic construction features in which the factors of support, shape, design and functional particularities are the origin of the object of this invention.

DESCRIPTION OF THE INVENTION

As set forth, the dispenser consists of two metering bodies, which are ergonomic receptacles of a conically-shaped projection and oval section; they are manufactured from a flexible or contractile material which has an outlet opening provided with a resilient valve that opens when the receptacle is pressed, allowing a portion of soapy substance to fall out, and optionally shielded by a small transverse cover hinged on one of the edges of the lower base. It is an outlet opening located at the smaller base of the receptacle, downwardly placed in its support element and which laterally, along the body of the receptacle, has a transparent bevel which enables seeing the level of the substance housed therein. The support means are integrated by an arcuate arm having a "U"-shaped transversal profile with internal reinforcements, and in coincidence with these holes for the passage of the fixing elements, which, on the underside, has a conically-shaped oval ring where the lower end of the receptacle is abuttingly housed, which ring, for that purpose, has a support flange, and on the upper part has a hood cover which is a hollow, "T"-shaped part with rounded sides, edges and cant edges, arranged horizontally.

According to the invention, the oval and conically-shaped ring for housing the lower end of the receptacle is an independent part having male anchoring elements, which are fixed to other respective anchoring elements arranged on the lower end of the support arm. The former are a set of two pins, horizontally parallel to the free gudgeon-shaped edge, and between these, a set of vertically parallel cylindrical pegs, and the latter are a pair of flaps coinciding with the pins against which the gudgeons, which enter through respective internal grooves tangent to said flaps, are embedded, and between these flaps, two holes where the pegs are embedded.

A hood cover constituted of a hollow "T"-shaped part in which the wide part is adapted to the upper base, of the largest section, of the metering receptacle, which also has a flange for acting as a stop of said cover which, at its narrow part is coupled on the end of the support arm, which is an inverted "U"-shaped arch and retained on its inner portion by a set of tongue-and-groove anchoring elements provided for on said arch and on the narrow part itself of the hood cover.

According to the invention, they are anchoring elements which allow the partial opening of said hood cover in a limited lifting movement, enough for releasing the receptacle in order to remove it from the lower ring for replacement thereof or any other necessary operation. According to the invention, an opening which is carried out by means of a pin—specifically a metal rod—which, by pressing against an anchoring pin of the hood cover, shifts its position from the stop where it is embedded in order to upwardly open the hood cover in a portion limited by the anchoring members themselves.

According to the invention, the anchoring members of the hood cover are constituted by a downward vertical pin, with the lower end in the shape of a crowfoot; with a hole on the surface arranged to one side of said pin and with respective tabs having a stepped profile on each one of the lower ends of the lateral sides, directly facing one another. And the anchoring elements of the upper end of the support arm are constituted by a central window over the surface from which an "L"-shaped downward vertical projection, with a rib in the form of a tubular small tube and vertical grooves on each one of the sides, directly facing each other, projects sideways.

According to the invention, the hood cover in its closed position maintains the crowfoot end of the vertical anchoring pin abutting against the lower edge of the "L"-shaped projection of the upper end of the support arm such that the hole of the surface coincides with the passage of the tubular rib and the side tabs of the cover embedded against the lower end of the side grooves of the upper end of the support arm. When the pin is introduced through the hole of the surface of the cover, it opens partially but enough the anchoring pin so that, pulling on the hood cover, it lifts it until the stepped side tabs fit against the upper end of the side grooves of said upper end of the support arm.

For the assembly of a set of two metering receptacles for soapy substances, the invention is provided with a simple prismatic tapered support in which the smaller base is the front plane of the support and the larger base is the bearing plane of said base, the inclined planes being the fixing bases of the support arms of the dispensing receptacles in divergent projection which, for such purposes, have through holes on the front plane for the lockscrews for attaching the support to the wall, and bores on the inclined planes for the lockscrews of the metering receptacle support arms.

A broader idea of the features of the invention will be carried out below in reference to the sheets of drawings attached to this specification which, somewhat schematically and only by way of example, show the preferred and essential details of the patent.

DESCRIPTION OF THE DRAWINGS

FIG. 6.1 shows an upper plan view of the hood cover (6) at 90° from FIG. 6.

FIG. 7.1 shows an cross-sectional detail taken by line I—I of FIG. 7, with the anchoring means for the lower ring (7).

PREFERRED EMBODIMENT OF THE INVENTION

Figure 1:
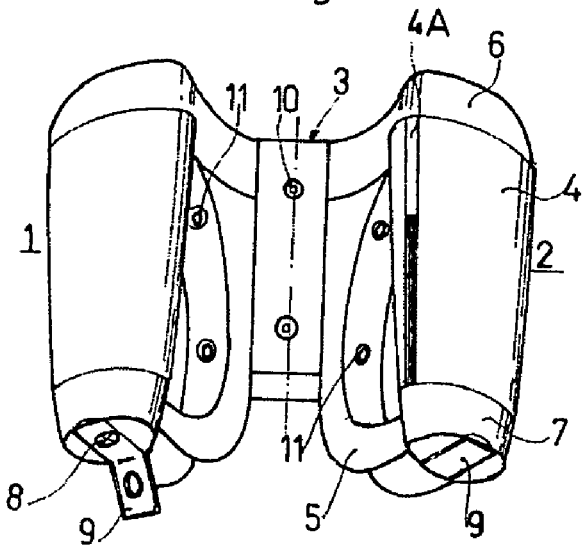
FIG. 1 shows a frontal perspective view of the central support (3) supporting a set of two dispensers (1) and (2) in divergent projection.
Figure 2:
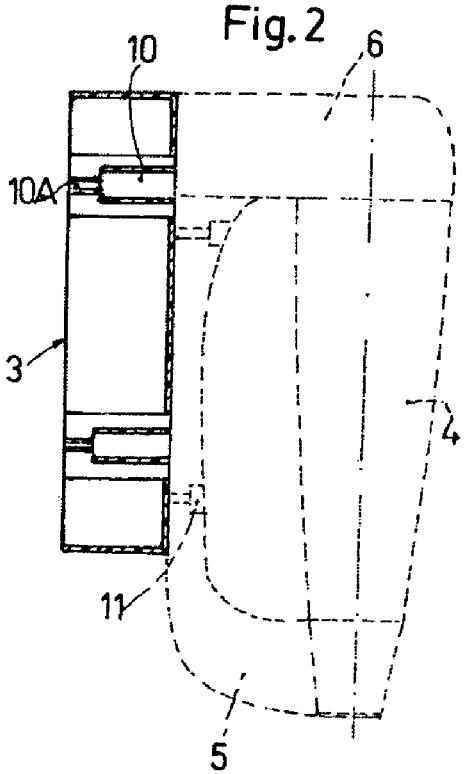
FIG. 2 shows a partially and vertically sectional view of the support (3) with the bores (10) (10A) for attachment to the wall.
Figure 3:
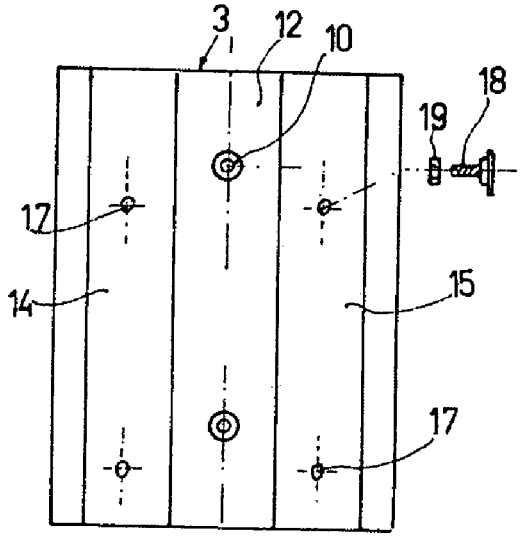
FIG. 3 shows a front elevational view of the support (3) showing the front plane (12) with the fixing bores (10), (10A), the back bearing plane (13) and the inclined planes (14) and (15) for the support arms (5).
Figure 4:
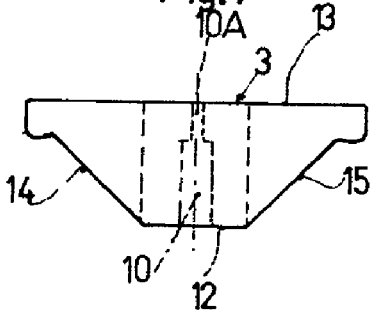
FIG. 4 shows an upper plan view of the support (3) at 90° from the previous figure.

A preferred embodiment of the invention is constituted by a support (3) for a pair of metering units (4) assembled on corresponding arcuate support arms (5) which are attached to the lateral planes of said support (3), in divergent projection, which is a hollow body molded in plastic with a regular tapered prismatic shape in which the smaller base is the front plane (12) provided with bores (10), with a double inner section (10A) for housing and passage of the lockscrews for attachment to the wall (neither shown nor referenced) at the larger base (13) of the support (3). It is a support which has inclined lateral planes (14) and (15), with bores (17) in which the arcuate support arms (5) are attached in divergent projection by means of screws (18) and nuts (19), assembled in said bores (17) through the holes (11) of said arm (5).

Figures 5, 6, 7, 8, 9, 10, 11, 12:
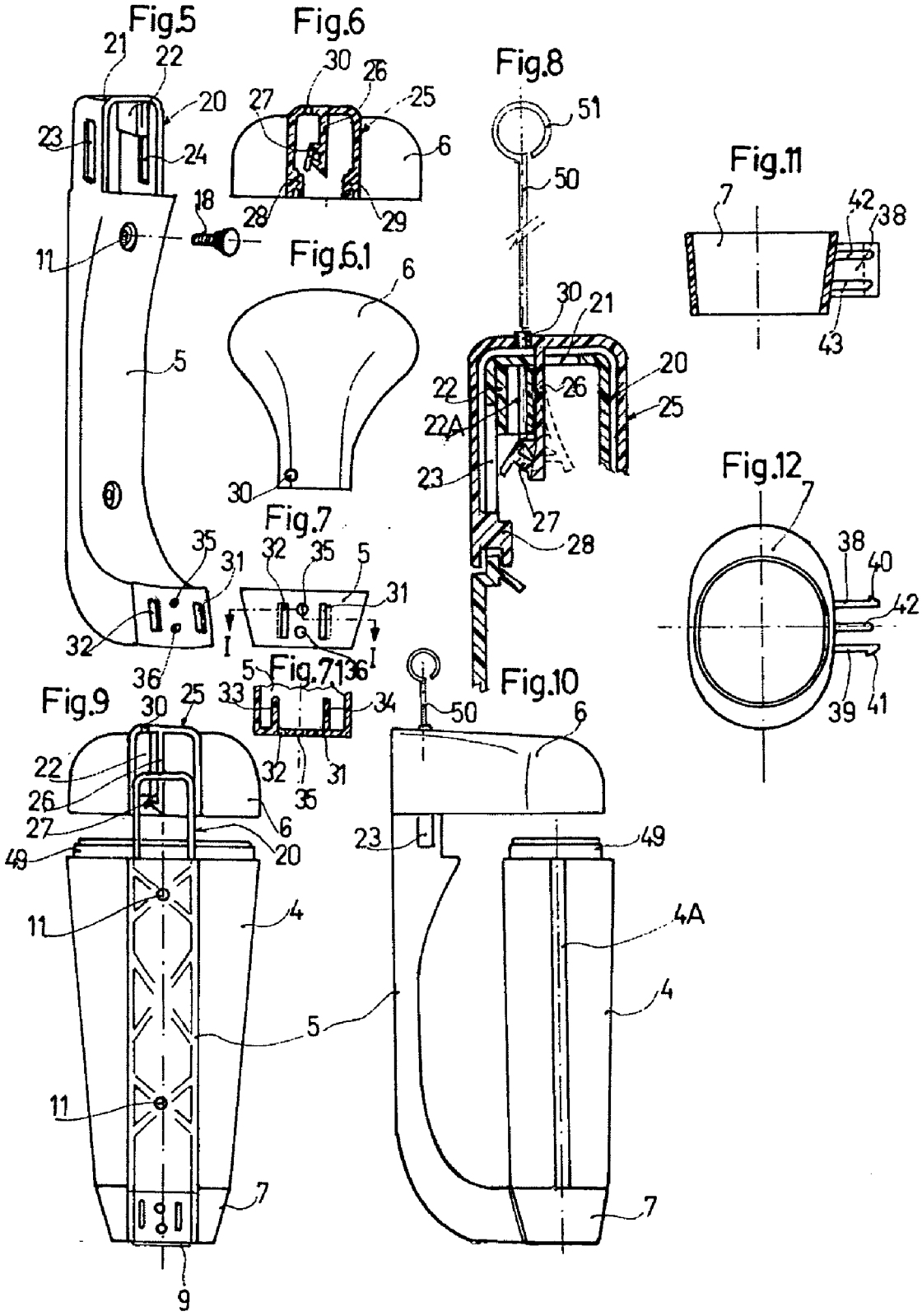
FIG. 5 shows a perspective view of the support arm (5) with the bores (11) for attachment to the support (3); with the upper arch (20) for the hood cover (6) and the lower end with the anchoring elements (31 to 36) for the lower ring (7).
FIG. 6 shows a rear elevational view of the hood cover (6) and its narrow part (25) vertically sectioned.
FIG. 7 shows a frontal detail of the lower end of the arm (5).
FIG. 8 shows a sectioned detail enlarged with regard to the remaining representations, and at full scale of the adaptation of the narrow end (25) of the hood cover (6) adapted on the upper arch (20) of the support arm (5).
FIG. 9 shows a rear elevational view of the support arm (5), metering unit (4) and hood cover (6) assembly, the latter in an open position.
FIG. 10 shows a side elevational view projected from the previous view at 90° thereof.
FIG. 11 shows a side elevational and vertically sectioned view of the lower ring (7) for housing the metering receptacle (4), with male anchoring elements for attachment to the lower end of the support arm (5).
FIG. 12 shows an upper plan view projected 90° from the previous view.

The support arms (5) have the arcuate shape shown in FIGS. 5 and 10. Its central area is provided with assembly holes (11), and the upper end with a rectangular arch (20) having a smaller section than the arm, with vertical side grooves (23 and 24) facing one another; with a window (21) on the surface and an internal, "L"-shaped inner vertical projection (22) with a tubular vertical rib or small tube (22A) backed against one of its sides, leaving the upper window (21) clear, all this for the proper adaptation of the hood cover (6) of FIGS. 6; 6.1; 8; 9 and 10.

A support arm (5) which, on the lower end, has anchoring elements for the attachment of the lower ring (7) of FIGS. 11 and 12. Said anchoring elements are constituted by parallel vertical grooves (32 and 33) tangent to equally vertical and parallel flaps (33 and 34) on the inside of said lower end of the arm (5) and, between each other, vertically aligned holes (35 and 36) for fixing respective male anchoring elements of the lower ring (7) for housing the lower end of the metering unit (4).

Said upper hood cover (6) is a hollow part molded in plastic which, in plan view, has a general "T" shape (FIG. 6.1), where the wide part is defined by an oval-shaped volume for retaining the metering unit (4) by the larger base or bottom thereof, and the narrow part (25) has an inverted "U"-shaped profile which, on the end or entrance of this narrow part (25), is internally provided with a slightly off-centered vertical pin (26) finished with an anchoring element (27) in the shape of a crowfoot, cotangential with a hole (30) provided for on the surface of this narrow part (25) and located between the stepped side tabs (28 and 29), reciprocally facing one another. Thus, and as shown in FIG. 8, the hood cover (6) is assembled on the upper end (20) of the support arm (5) by means of pressure, making the stepped tabs (28 and 29) embed in the respective grooves (23 and 24) of the end (20); making the pin (26) pass through the window (21) of the former such that the anchoring element (27) is embedded against the lower edge of the projection (22). In this position, the hood cover (6) retains the metering unit (4) in a non-detachable manner between it and the lower ring (7) so that it cannot be freely handled or easily stolen. When it is desired to replace the metering receptacle (4), it is necessary to use the pin key (50), as shown in FIG. 8. It is introduced through the hole (30), passed through the small tube (22A), pushing against the anchoring element (27), it opens the pin (26), releasing it from abutment against the projection (22) such that the cover (6) can be lifted a portion determined by the grooves (23 and 24) of the upper end (20) and stepped tabs (28 and 29) of the narrow part (25), as shown in FIGS. 9 and 10, releasing the metering receptacle (4) which was retained by the stepped area (49) of said metering receptacle (4). Said separation (FIGS. 9 and 10) is also sufficient for removing the metering receptacle (4) from the lower ring (7) in which it is embedded to the rim (47) of the lower end (44) of said metering receptacle (4).

As previously mentioned, the lower ring (7) for housing the lower end (44) of the metering receptacle (4) is laterally and externally provided with parallel vertical male anchoring elements (38 and 39) and with a harpooned end (40 and 41), and between these a pair of parallel and vertically aligned cylindrical pegs (42 and 43), which are respectively assembled on the lower end of the support arm (5); the anchoring elements (38 and 39) passing through a pair of vertical grooves (31 and 32) and connecting with the internal flaps (33 and 34), while the pegs (42 and 43) are introduced in the holes (35 and 36) of said lower end of the support arm (5).

Figure 13:
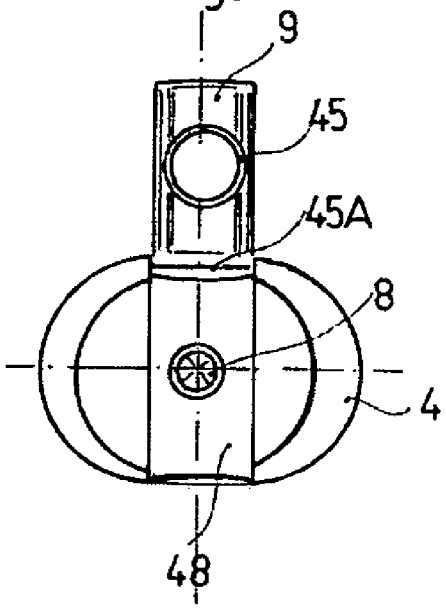
FIG. 13 shows a lower plan view of the smaller base (44) of the metering receptacle (4) with the small cover (9) of the outlet opening (8) open.
Figure 14:
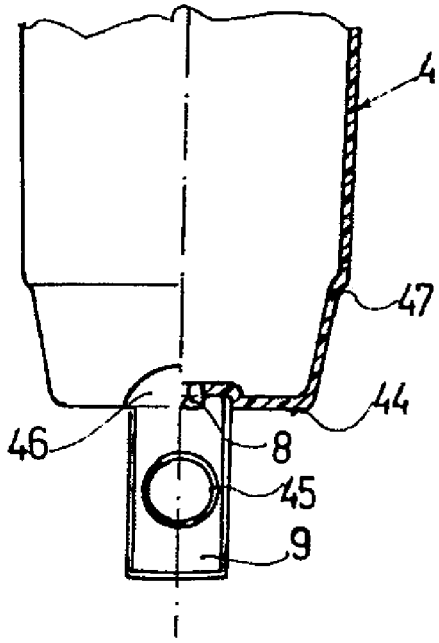
FIG. 14 shows a partial elevational view of the lower end (44) of the representation of FIG. 13, partially sectioned.
Figure 15:
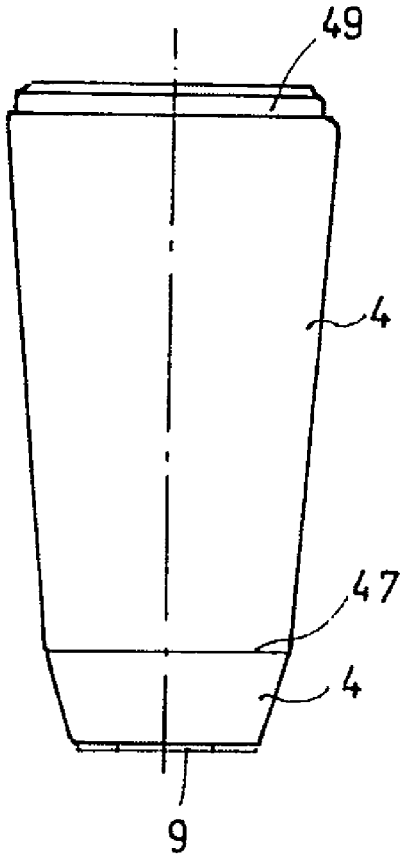
FIG. 15 shows a front elevational view of the metering receptacle (4) with the small cover (9) closed.
Figure 16:
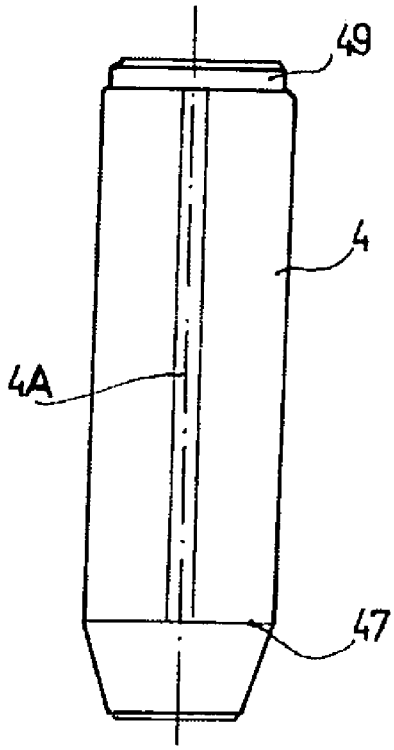
FIG. 16 shows a side elevational view projected 90° from the previous view, showing the level viewer (4A).

The lower base (44) of the metering receptacle (4) has a transversal recess (48) (FIGS. 13 and 14) where the outlet opening (8) is located, shielded by the small cover (9), which has a central circular flange (45) for closing over the opening (8); an hinged end (45A) and, on the opposite end, over the recessed edge (48), a semicircular notch (46) to facilitate opening the small cover (9). It is a small cover which can be closed once the receptacle (4) is used, to prevent possible dripping.

The pin key (50) used to release the anchoring of the hood cover (6) is a rod which, in this case, has an upper ring (51) for pulling on it easily and removing it with no difficulty.

Having suitably described the nature of the invention, it is stated for the suitable purposes that the invention is not limited to the express details of this description, but rather that those modifications which do not alter the essential features of the invention could be introduced thereto, in which, all its parts and pieces, except for the fixing elements and pin for releasing the previous anchoring, are manufactured of resistant and aseptic plastics materials, and in which the metering receptacles can be replaced, restored or refilled with absolute ease.

What is claimed is:

1. A double metering dispenser for hygienic substances, comprising a contractible metering receptacle with its outlet opening on the lower end, housed in a likewise lower ring connected to the corresponding end of a support arm, arcuate and retained at the upper part by means of a hood cover assembled on the upper end of said arm and which vertically shifts or moves in order to release it and to thus be able to replace the metering receptacle integrating a dispenser assembly which is characterized in that it consists of two metering receptacles (4) assembled on respective support arms (5) having central perforations (11) for being assembled, by means of screws (18) and nuts (19), on a support (3) constituted by a regular, tapered prismatic hollow body which is provided with double section perforations (10-10A) in the central part for attachment to the wall, and perforations (17) on the inclined lateral planes (14 and 15) for attachment of the support arms (5), in divergent projection, which have hood cover (6) adjustment means on their upper end and, on the lower end, fixing means for the ring (7) for housing the metering receptacles (4) provided with means for shielding the metering outlet opening (8) of said receptacles (4).

2. A double metering dispenser for hygienic substances according to claim 1, wherein the adjustment means for the hood cover comprises the upper end of the support arm (5) having a smaller section than the latter and having an openworked arch (20) with a central window (21) on the surface, and facing vertical grooves (23 and 24) on the side walls and, tangent to one of said walls, on the inside it has an "L"-shaped projection (22) with a tubular rib or small tube (22A) backed against it for anchoring the hood cover (6) and for the access of a release pin (50), respectively.

3. A double metering dispenser for hygienic substances according to claim 1, wherein the adjustment means of the hood cover comprises a vertical pin (26) finished in an anchoring element (27) shaped like a crowfoot and located inside the narrow, inverted "U"-shaped part (25) of the hood cover (6) which, on its sides, is provided with stepped profile tabs (28 and 29) facing one another and a perforation (30) on the surface, for, respectively: connecting with the "L"-shaped projection (22); guiding in the grooves (23 and 24) and communication of the adjustment means of the upper end (20) with the tubular rib 22A).

4. A double metering dispenser for hygienic substances according to claim 1, wherein the fixing means of the lower ring for housing the metering receptacle on the lower end of the support arm comprises a pair of vertical and parallel grooves (31 and 32) tangent to likewise parallel and vertical flaps (33 and 34) located on the inside of said end, and by a pair of perforations (35 and 36) vertically aligned and located between the latter.

5. A double metering dispenser for hygienic substances according to claim 1, the fixing means of the lower ring for housing the metering receptacle in the ring itself are characterized in that they are anchoring elements constituted of a pair of vertical and parallel projections (38 and 39) with harpooned or gudgeon-shaped edges (40 and 41), and between these there are a pair of cylindrical pegs (42 and 43), all located on one side of the ring (7) and respectively intended for being embedded in the flaps (33 and 34) and being housed in the holes (35 and 36) of the lower end of the support arm (5).

6. A double metering dispenser for hygienic substances according to claim 1, the shielding means of the metering outlet opening of the metering receptacle are characterized in that they are integrated by a small transversal cover (9), adapted to a corresponding transversal recess (48) on the lower base (44) of said metering receptacle (4), hinged on one end (45A) and free on the other end; it is provided with a central circular projection (45) for closing the outlet opening (8) and provided with a notch (46) opposite to the hinged side (45A) for facilitating opening of the cover (9).

7. A double metering dispenser for hygienic substances according to claim 1, the release pin is characterized in that it is a cylindrical rod (50) provided with a ring (51) on its upper end for facilitating its removal.

* * * * *